US008377859B2

(12) United States Patent
Poirier et al.

(10) Patent No.: US 8,377,859 B2
(45) Date of Patent: Feb. 19, 2013

(54) HYDROCARBON FLUIDS WITH IMPROVED POUR POINT

(75) Inventors: Marc-Andre Poirier, Sarnia (CA); Jacob J. Habeeb, Westfield, NJ (US); Chengrong X. Wang, Glen Mills, PA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 773 days.

(21) Appl. No.: 12/220,171

(22) Filed: Jul. 22, 2008

(65) Prior Publication Data

US 2009/0029889 A1 Jan. 29, 2009

Related U.S. Application Data

(60) Provisional application No. 60/961,917, filed on Jul. 25, 2007.

(51) Int. Cl.
*C10M 169/04* (2006.01)
*C10M 129/50* (2006.01)

(52) U.S. Cl. ..... 508/481; 508/480; 508/479; 508/502

(58) Field of Classification Search ..... 508/367, 508/463, 465, 478, 479, 502, 480, 481
See application file for complete search history.

(56) References Cited

U.S. PATENT DOCUMENTS

| | | | | |
|---|---|---|---|---|
| 2,730,501 | A | 1/1956 | Otto | |
| 3,019,188 | A * | 1/1962 | Matuszak et al. | 508/481 |
| 3,679,585 | A | 7/1972 | Brook et al. | |
| 4,098,708 | A | 7/1978 | Stuebe | |
| 4,965,004 | A | 10/1990 | Schlicht et al. | |
| 5,672,570 | A * | 9/1997 | Miyaji et al. | 508/192 |
| 5,686,398 | A | 11/1997 | Minokami et al. | |
| 5,965,495 | A * | 10/1999 | Goto et al. | 508/192 |
| 6,348,438 | B1 | 2/2002 | Le Coent et al. | |
| 6,599,867 | B2 | 7/2003 | Hammond et al. | |
| 6,642,190 | B2 | 11/2003 | Hammond et al. | |
| 6,784,143 | B2 | 8/2004 | Locke et al. | |
| 7,696,136 | B2 * | 4/2010 | Migdal et al. | 508/367 |
| 2003/0100453 | A1 * | 5/2003 | O'Rear | 508/110 |
| 2005/0198894 | A1 * | 9/2005 | Migdal et al. | 44/388 |
| 2006/0014653 | A1 | 1/2006 | Busse et al. | |
| 2006/0052254 | A1 | 3/2006 | Shaw | |
| 2006/0116302 | A1 | 6/2006 | Deckman et al. | |
| 2008/0026962 | A1 | 1/2008 | Poirier | |
| 2008/0051307 | A1 * | 2/2008 | Li | 508/507 |

FOREIGN PATENT DOCUMENTS

| | | |
|---|---|---|
| EP | 1 233 053 A1 | 8/2002 |
| GB | 869084 | 5/1961 |

OTHER PUBLICATIONS

Thaddeus S. Franczyk, et al., "Stereognostic Coordination Chemistry. 1. The Design and Synthesis of Chelators for the Uranyl Ion", *Journal of American Chemistry Society* 114 (1992), pp. 8138-8146.
Research Disclosure, "Alkyl Salicylates as Lubricating Oils", vol. 414, 10 1998, p. 1307.
Anonymous, "Alkyl Salicylates as Lubricating Oils", Research Disclosure, vol. 414, Oct. 1998, p. 1307.

* cited by examiner

*Primary Examiner* — Pamela H Weiss
(74) *Attorney, Agent, or Firm* — Robert A. Migliorini

(57) ABSTRACT

The addition of alkyl salicylic acids and esters represented by Formula I

I

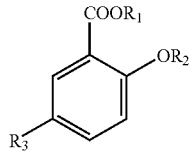

where $R_1$=H or $C_{12}$ to $C_{22}$ linear alkyl group; $R_2$=H or linear $C_{12}$ to $C_{22}$ carbonyl group; and $R_3$=linear $C_{12}$ to $C_{22}$ alkyl group reduces the pour point of a hydrocarbon base oil. Thus, both a method for reducing the pour point of hydrocarbon oils and lubricating composition containing pour point reducing salicylates are provided. The hydrocarbon base oil in such method and composition preferably is a Group III base oil.

8 Claims, No Drawings

HYDROCARBON FLUIDS WITH IMPROVED POUR POINT

This application claims benefit of Provisional Application 60/961,917 filed Jul. 25, 2007.

FIELD OF THE INVENTION

The present invention relates to hydrocarbon fluids that typically require pour point depressants to achieve desired low temperature properties. More particularly, the invention relates to improving the pour point of hydrocarbon fluids by use of certain salicylic acid derivatives. In addition, the present invention relates to hydrocarbon base oil compositions base oil.

BACKGROUND OF THE INVENTION

As is well known, hydrocarbon fluids, such as hydroisomerized or isodewaxed waxes, often require the addition of a small amount of an additive to lower the pour point of the fluid to a desirable level. Such additives are known as pour point depressants. Oils of low pour point, be they motor oils, hydraulic fluids, gear oils, automatic transmission fluids or the like, are especially desirable for use where low temperatures are encountered.

Typical pour point depressants include polymethacrylate esters, alkylated fumarate or maleate vinyl acetate copolymers, and styrene maleate co-polymers. Because these pour point depressants are high molecular weight co-polymers, they may affect the viscosity of fluids to which they are added, and they may shear under conditions of use. It would be useful, therefore, to have pour point depressants that are not high molecular weight co-polymers.

SUMMARY OF THE INVENTION

It has now been discovered that the addition of alkyl salicylic acids and esters represented by Formula I

I

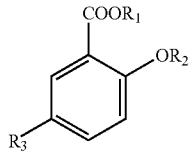

where $R_1$=H or $C_{12}$ to $C_{22}$ linear alkyl group; $R_2$=H or linear $C_{12}$ to $C_{22}$ carbonyl group; and $R_3$=linear $C_{12}$ to $C_{22}$ alkyl group or linear $C_{12}$ to $C_{22}$ carbonyl group, significantly reduces the pour point of a hydrocarbon base oil especially Group III base oils.

Thus, in one embodiment of the invention, there is provided a method for lowering the pour point of a hydrocarbon base oil by adding to the oil an effective amount of an additive of Formula 1.

In another embodiment of the invention, there is provided a lubricating composition comprising a major amount of a hydrocarbon base oil and a minor but effective pour point depressing amount of an additive of Formula I.

In a particularly preferred embodiment of the above method and lubrication oil composition, the base oil preferably comprises a Group III base oil and more preferably a GTL Group III oil.

Other embodiments will become apparent from the detailed description that follows.

DETAILED DESCRIPTION OF THE INVENTION

The pour point additive of the invention comprises salicylic acid derivatives represented by Formula I

I

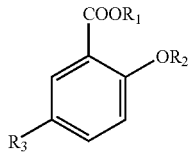

where $R_1$=H or $C_{12}$ to $C_{22}$ linear alkyl group; $R_2$=H or $C_{12}$ to $C_{22}$ carbonyl group; and $R_3$=$C_{12}$ to $C_{22}$ linear alkyl group or $C_{12}$ to $C_{22}$ carbonyl group, which when added to a Group III base oil significantly lowers the pour point of the oil. Indeed, such salicylic acid derivates significantly lower the pour point of base oils comprising Group III base oils and especially GTL base oils.

When $R_1$ and $R_3$ are alkyl groups, preferably each is a linear $C_{18}$-alkyl group.

When $R_2$ and $R_3$ are carbonyl groups, preferably each is a $C_{18}$ carbonyl group.

Typical examples of compositions of the invention are those of Formula I where:

(a) $R_1$=H and $R_2$ and $R_3$=$C_{12}$ to $C_{22}$ carbonyl, preferably $C_{17}$ carbonyl;

(b) $R_1$=$C_{12}$ to $C_{22}$ alkyl, preferably $C_{18}$ alkyl and $R_2$ and $R_3$=$C_{12}$ to $C_{22}$ carbonyl, preferably $C_{18}$ carbonyl;

(c) $R_1$=$C_8$ to $C_{18}$ alkyl, preferably $C_{18}$ alkyl, $R_2$=1 and $R_3$=$C_8$ to $C_{18}$ carbonyl, especially $C_{17}$ carbonyl;

(d) $R_1$ and $R_3$=$C_8$ to $C_{18}$ alkyl, preferably $C_{18}$ alkyl and $R_2$=H.

The salicylic acid derivatives are prepared by well known methods. For example, salicylic acid is acylated by the Friedel-Crafts type reaction of an acid chloride, such as stearoyl chloride, with salicylic acid in the presence of aluminum chloride catalyst. Similarly, the salicylic acid may be alkylated by reaction with an alkyl chloride, such as stearyl chloride, in the presence of aluminum chloride catalyst. The acylated or alkylated salicylic acid may then by esterified by reaction with an appropriate alcohol. Optionally, the phenolic group may be esterified using an acid or acid chloride.

The pour point depressant additives of the invention have been found to be particularly effective in lowering the pour point of Group III base stocks and base oils, especially hydroisomerized or isodewaxed Group III oils including Fischer-Tropsch wax derived base stocks and base oils (GTL oils).

As is well known, the American Petroleum Institute has established a classification system for base oils (API Publication 1509, www.API.org). Group III oils are one of the five categories established by the API. The properties of all five categories are shown in Table 1.

TABLE 1

| | Saturates | Sulfur | Viscosity Index |
|---|---|---|---|
| Group I | <90 wt % and/or | >0.03 wt % and | ≧80 and <120 |
| Group II | ≧90 and | <0.3 wt % and | ≧80 and <120 |
| Group III | ≧90 and | <0.3 wt % and | ≧120 |
| Group IV | Polyalphaolefins (PAO) | | |
| Group V | All other base oil stocks not included in Group I, II, III or IV | | |

As used herein, the term base stock refers to a single oil secured from a single crude source and subjected to a single processing scheme and meeting a particular specification. The term base oil refers to oils prepared from at least one base stock.

In one embodiment of the invention, there is provided a method for lowering the pour point of a hydrocarbon base oil, especially a base oil comprising a Group III oil, and preferably a GTL Group III oil, by adding to the oil an effective amount of a pour point depressant additive of the invention. The amount of the additive of the invention added to the base oil generally will be in the range of about 0.055 wt % to about 5.0 wt %, and preferably about 0.1 wt % to about 0.5 wt % based on the weight of the base oil.

GTL base oils are derived from GTL materials, a description of which follows.

GTL materials are materials that are obtained via one or more synthesis, combination, transformation, rearrangement, and/or degradation/deconstructive processes from gaseous carbon-containing compounds. Preferably, the GTL materials are derived from synthesis gas such as in the Fischer-Tropsch (FT) synthesis process wherein a synthesis gas comprising a mixture of $H_2$ and CO is catalytically converted into hydrocarbons, usually waxy hydrocarbons, that are generally converted to lower boiling materials by hydroisomerization and/or dewaxing. These processes are well known in the art.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about from about 3 to 7 $mm^2/s$ at 100° C. and a viscosity index of about 130 or greater. Reference herein to Kinematic viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, generally greater than 80 wt % non-cyclic isoparaffins, preferably greater than 85 wt % non-cyclic isoparaffins, more preferably greater than 90 wt % non-cyclic isoparaffins and most preferably greater than 95 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks.

GTL base stock(s), isomerized or isodewaxed wax-derived base stock(s), have a beneficial kinematic viscosity advantage over conventional Group II and Group III base stocks and base oils, and so may be very advantageously used with the instant invention. Such GTL base stocks and base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole. Preferably $BI \geqq 25.4$ and $(CH_2 \geqq 4) \leqq 22.5$.

The preferred GTL base oil can be further characterized, if necessary, as having less than 0.1 wt % aromatic hydrocarbons, less than 1 wt % and after less than 20 wppm nitrogen containing compounds, less than 20 wppm sulfur containing compounds. Pour point of less than −18° C., preferably less than −30° C. provides good results. They have more often a nominal boiling point of 370° C.$^+$. On average they average fewer than 10 hexyl or longer branches per 100 carbon atoms and on average have more than 16 methyl branches per 100 carbon atoms.

They also can be characterized by a combination of dynamic viscosity, as measured by CCS at −40° C., and kinematic viscosity, as measured at 100° C. represented by the formula: DV (at −40° C.)<2900 (KV@100° C.)−7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1 H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the a-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 $MHz^3$ CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ~29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

(a) calculate the average carbon number of the molecules in the sample which is accomplished with sufficient accuracy for lubricating oil materials by simply dividing the molecular weight of the sample oil by 14 (the formula weight of $CH_2$);

(b) divide the total carbon-13 integral area (chart divisions or area counts) by the average carbon number from step a. to obtain the integral area per carbon in the sample;

(c) measure the area between 29.9 ppm and 29.6 ppm in the sample; and (d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

In one embodiment of the invention, there is provided a composition comprising a major amount of a base oil wherein said base oil comprises from about 70 wt % to 100 wt % of a hydrocarbon base oil, especially a Group III oil, and an effective amount of a pour point depressant additive of the invention. Preferably, the Group III oil is a GTL oil. The base oil may contain up to about 30 wt % of any one or more of Group I, II, IV and V base oils.

Particularly preferred compositions of the invention are those wherein the base oil comprises about 75 wt % to about 85 wt % of a GTL Group III oil and wherein the additive of the invention is present in an amount of from about 0.05 wt % to about 5.0 wt % based on the weight of the base oil and is selected from the group consisting of salicylic derivatives represented by Formula I wherein:

$$R_1{=}H,\ R_2 \text{ and } R_3{=}C_{17}H_{35}CO; \quad (a)$$

$$R_1{=}C_{18}H_{37},\ R_2 \text{ and } R_3{=}C_{17}H_{35}CO; \quad (b)$$

$$R_1{=}C_{18}H_{37},\ R_2{=}H,\ R_3{=}C_{17}H_{35}CO; \quad (c)$$

$$R_1 \text{ and } R_3{=}C_{18}H_{37},\ R_2{=}H; \quad (d)$$

and mixtures thereof.

The additives of the invention may be added to the Group III oil neat or in a hydrocarbon diluent. Thus, one embodiment of the invention comprises a pour point depressant additive concentrate comprising a major amount of one or more additives of the invention, for example, from about 60 wt % to about 95 wt % bases on the total weight of the concentrate and a hydrocarbon diluent. Suitable hydrocarbon diluents include high boiling point diluents such as heavy aromatic solvents, polyalphaolefins, diesters, and alkylated aromatics such as alkylated naphthalene.

In another aspect of the invention, a lubricant oil composition is provided comprising:

a major amount of a base oil containing about 70 wt % to 100 wt % of a Group III oil;

from about 0.05 wt % to about 5 wt %, based on the weight of the lubricant composition, of one or more pour point depressant additives of the invention; and one or more lubricant additives selected from detergents, dispersants, antiwear additives, antioxidants, VI improvers, rust inhibitors and antifoamants.

Dispersants useful in this invention are borated and non-borated nitrogen-containing compounds that are oil soluble salts, amides, imides and esters made from high molecular weight mono and di-carboxylic acids and various amines. Preferred dispersants are the reaction of polyolefins ($C_2$-$C_5$ olefins), such as polyisobutenyl succinic anhydride with an alkoxy or alkylene polyamine such as tetraethylenepentamine. The borated dispersants contain boron in an amount from about 0.5 to 5.0 wt % based on dispersants. Dispersants are used generally in amounts from about 0.5 to about 10 wt % based on the total weight of the lubricating oil composition.

Examples of suitable antioxidants are hindered phenols, such as 2,6-di-tert-butylphenol, 4,4'-methylene bis(2,6-di-tert-butylphenol)2,6-di-tert-butyl-p-cresol and the like, amine antioxidants such as alkylated naphthylamines, alkylated diphenylamines and the like. Antioxidants are used generally in amounts from about 0.01 to about 3 wt % based on the total weight of the lubricating oil composition.

Anti-wear agents generally are oil-soluble zinc dihydrocarbyldithiophosphates having the alkyl group in the range from about $C_2$-$C_8$. They are typically present in amounts of from about 0.01 to 5 wt %, preferably 0.4 to 1.5 wt % based on total weight of the lubricating oil composition.

Useful friction modifiers include molybdenum dithiocarbamates. Examples of molybdenum dithiocarbamates include $C_6$-$C_{18}$ dialkyl or diaryldithiocarbamates, or alkylaryldithiocarbamates such as dibutyl, diamyl, diamyl-di-(2-ethylhexyl), dilauryl, dioleyl and dicyclohexyl dithiocarbamate. The amount of molybdenum dithiocarbamate(s) present in the oil ranges from about 0.05 to about 1 wt % based on total weight of lubricating oil composition. The molybdenum content can range from about 20 to about 500 ppm, most preferably from about 50 to about 120 ppm.

Defoamants, typically silicone compounds such as polydimethylsilozane polymers, are commercially available and may be used in conventional minor amounts along with other additives such as demulsifiers. Usually the amount of these additives combined is less than 1 wt % and often less than 0.2 wt % based on total weight of lubricating composition.

Rust inhibitors selected from the group consisting of non-ionic polyoxyalkylene polyols and esters thereof, polyoxyalkylene phenols, and amenic alkyl sulfonic acids may be used. Typically, they will be used in an amount of about 0.1 wt % to about 1.0 wt % based on the total weight of the composition.

Corrosion inhibitors that may be used include, but are not limited to, benzotriazoles, tolyltriazoles and their derivates. Typically, they are used in amounts ranging from about 0.1 wt % to about 1.0 wt % based on the total weight of the composition.

The invention is further illustrated by the following examples.

EXAMPLES

The pour point depressant additives in the examples were:

Compound A:

This compound is represented by Formula A

A

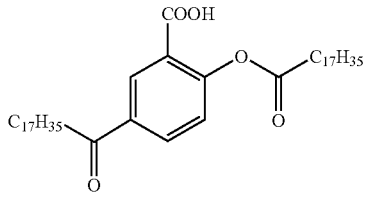

Compound B:

This compound is represented by Formula B

B

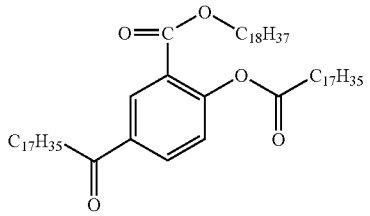

Compound C:

This compound is represented by Formula C

C

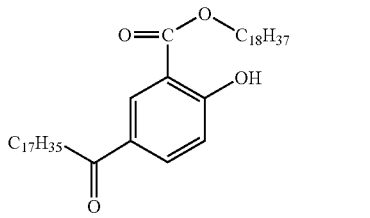

Compound D:

This compound is represented by Formula D

D

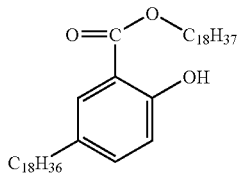

Example 1

This example shows the significant pour point reduction that Compounds A and B have on a GTL base oil. The pour point was determined on the four fluids shown in Table 2. The Table also shows the amount of additives used in Fluids 2 to 4.

TABLE 2

| | Fluid 1 | Fluid 2 | Fluid 3 | Fluid 4 |
|---|---|---|---|---|
| GTL Base oil, wt % | 100.0 | 99.90 | 99.70 | 99.90 |
| Compound A, wt % | 0 | 0.10 | 0.30 | 0 |
| Compound B, wt % | 0 | 0 | 0 | 0.10 |
| Properties | | | | |
| KV @ 100° C., $mm^2/s$ | 3.65 | — | — | — |
| Pour Point, ° C. | −27 | −45 | −48 | −45 |
| Delta, ° C | 0 | −18 | −21 | −18 |

Example 2

As with Example 1, this example shows the effect that pour point depressant additives C and D have on a GTL oil. The data are presented in Table 3.

TABLE 3

| | Fluid 1 | Fluid 4 | Fluid 5 | Fluid 6 |
|---|---|---|---|---|
| GTL Base oil, wt % | 100.0 | 99.90 | 99.90 | 99.90 |
| Compound B, wt % | 0 | 0.10 | 0 | 0 |
| Compound C, wt % | 0 | 0 | 0.10 | 0 |
| Compound D, wt % | 0 | 0 | 0 | 0.10 |
| Properties | | | | |
| KV @ 100° C., $mm^2/s$ | 3.65 | — | — | — |
| Pour Point, ° C. | −27 | −45 | −48 | −39 |
| Delta, ° C. | 0 | −18 | −21 | −12 |

Example 3

This example shows the beneficial effect that compounds B, C and D have on a GTL oil having a higher kinematic viscosity than the GTL oil of Examples 1 and 2. The results are shown in Table 4.

TABLE 4

| | Fluid 7 | Fluid 8 | Fluid 9 | Fluid 10 |
|---|---|---|---|---|
| GTL Base oil, wt % | 100.0 | 99.70 | 99.70 | 99.70 |
| Compound B, wt % | 0 | 0.30 | 0 | 0 |
| Compound C, wt % | 0 | 0 | 0.30 | 0 |
| Compound D, wt % | 0 | 0 | 0 | 0.30 |
| Properties | | | | |
| KV @ 100° C., $mm^2/s$ | 6.05 | — | — | — |
| Pour Point, ° C. | −18 | −30 | −33 | −24 |
| Delta, ° C. | 0 | −12 | −15 | −6 |

Example 4

This example illustrates the beneficial effect of the additives of the invention on fully formulated engine lubricants. In this example, the GTL base oil had a Kv at 100° C. of 4.6 $m^2/s$. The co-base oil was a Group V base oil that had a Kv at 100° C. of 5.8 $m^2/s$. The compositions and pour point data are given in Table 5.

TABLE 5

| | Fluid 11 | Fluid 12 | Fluid 13 | Fluid 14 |
|---|---|---|---|---|
| GTL Base oil, wt % | 80.3 | 79.8 | 79.8 | 79.8 |
| Co-Base Oil, wt % | 6.8 | 6.8 | 6.8 | 6.8 |
| VI Improver, wt % | 10.3 | 10.3 | 10.3 | 10.3 |
| Anti-Wear Agents, wt % | 1.0 | 1.0 | 1.0 | 1.0 |
| Antioxidants, wt % | 1.5 | 1.5 | 1.5 | 1.5 |
| Antifoamant, wt % | 0.1 | 0.1 | 0.1 | 0.1 |
| Compound B, wt % | 0 | 0.5 | 0 | 0 |
| Compound C, wt % | 0 | 0 | 0.5 | 0 |
| Compound D, wt % | 0 | 0 | 0 | 0.5 |
| Properties | | | | |
| Pour Point, ° C. | −21 | −30 | −30 | −21 |
| Delta, ° C. | 0 | −9 | −9 | 0 |

What is claimed is:

1. A method for lowering the pour point of a hydrocarbon base oil comprising a Group III oil consisting essentially of a GTL oil, the method comprising adding to the oil an effective amount of a pour point depressant represented by Formula I,

I

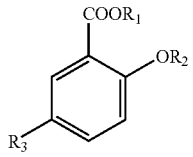

wherein $R_1$=H and $R_2$ and $R_3$=linear $C_{17}H_{35}CO$.

2. The method of claim 1 wherein the pour point depressant is added in an amount ranging from about 0.05 wt % to about 5.0 wt % based on the weight of the base oil.

3. An additive concentrate suitable for reducing the pour point of a lubricating oil comprising a Group III base oil consisting essentially of a GTL oil, said additive concentrate-_comprising a major amount of a compound represented by Formula I,

I

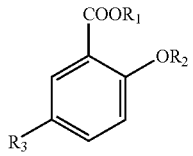

wherein $R_1$=H and $R_2$ and $R_3$=linear —$C_{17}H_{35}CO$.

4. The concentrate of claim 3 wherein the compound is present in an amount ranging from about 60 wt % to about 95 wt % based on the total weight of the concentrate.

5. A composition comprising:

a major amount of a Group III oil consisting essentially of a GTL oil obtained by hydroisomerizing or isodewaxing a Fischer-Tropsch waxy hydrocarbon; and, a minor amount of a pour point depressant represented by Formula I,

I

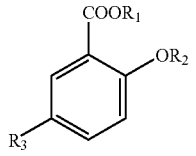

wherein $R_1$=H and $R_2$ and $R_3$=linear —$C_{17}H_{35}CO$.

6. The composition of claim 5 wherein the pour point depressant is present in an amount of from about 0.05 wt % to about 5 wt % based on the total weight of the base oil.

7. A lubricant composition comprising:

a major amount of a base oil containing about 70 wt % to 100 wt % of a Group III oil consisting essentially of a GTL oil, based on the weight of the oil; from about 0.05 wt % to about 5.0 wt % based on the weight of the lubricant composition, of one or more pour point depressant additives represented by Formula I

I

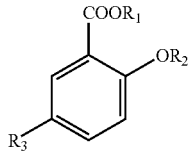

wherein $R_1$=H and $R_2$ and $R_3$=linear —$C_{17}H_{35}CO$;

and one or more lubricant additives selected from detergents, dispersants, antiwear additives, antioxidants, VI improvers, rust inhibitors and antifoamants.

8. The composition of claim 7 wherein the base oil includes from about 10 wt % to about 30 wt % of at least one oil selected from Groups I, II, IV and V oils.

* * * * *